US009963840B2

(12) United States Patent
Hills et al.

(10) Patent No.: US 9,963,840 B2
(45) Date of Patent: May 8, 2018

(54) METHODS, COMPOSITIONS AND SYSTEMS FOR ENHANCING THE USEFUL LIFE OF A TRANSPORTATION SURFACE

(75) Inventors: Dal N. Hills, Midway, UT (US); Kent Barrus, Provo, UT (US); Jeffrey L. Koebrick, St. Augustine, FL (US)

(73) Assignee: Advanced Concrete Technologies LLC, Orem, UT (US)

( * ) Notice: Subject to any disclaimer, the term of this patent is extended or adjusted under 35 U.S.C. 154(b) by 1220 days.

(21) Appl. No.: 13/559,564

(22) Filed: Jul. 26, 2012

(65) Prior Publication Data

US 2013/0029036 A1 Jan. 31, 2013

Related U.S. Application Data

(60) Provisional application No. 61/511,603, filed on Jul. 26, 2011, provisional application No. 61/643,219, filed on May 4, 2012.

(51) Int. Cl.

| | |
|---|---|
| ***E01C 23/06*** | (2006.01) |
| ***B05D 3/12*** | (2006.01) |
| ***B05D 7/00*** | (2006.01) |
| ***E01C 23/088*** | (2006.01) |
| ***E01C 23/02*** | (2006.01) |
| ***E01C 23/082*** | (2006.01) |
| ***E01C 11/00*** | (2006.01) |
| ***E01C 23/09*** | (2006.01) |
| ***E01C 23/08*** | (2006.01) |
| ***E01C 23/085*** | (2006.01) |
| ***B05D 5/08*** | (2006.01) |
| ***B05D 5/00*** | (2006.01) |
| ***B05D 3/10*** | (2006.01) |

(52) U.S. Cl.

CPC ..... *E01C 23/06* (2013.01); *B05D 3/104* (2013.01); *B05D 3/12* (2013.01); *B05D 5/005* (2013.01); *B05D 5/08* (2013.01); *E01C 11/00* (2013.01); *E01C 11/005* (2013.01); *E01C 23/028* (2013.01); *E01C 23/08* (2013.01); *E01C 23/081* (2013.01); *E01C 23/082* (2013.01); *E01C 23/088* (2013.01); *E01C 23/0825* (2013.01); *E01C 23/0855* (2013.01); *E01C 23/0885* (2013.01); *E01C 23/09* (2013.01); *E01C 23/092* (2013.01); *E01C 23/094* (2013.01); *E01C 23/0906* (2013.01); *E01C 23/096* (2013.01); *E01C 23/098* (2013.01); *E01C 23/0913* (2013.01); *E01C 23/0926* (2013.01); *E01C 23/0933* (2013.01); *E01C 23/0946* (2013.01); *E01C 23/0953* (2013.01); *E01C 23/0966* (2013.01); *E01C 23/0973* (2013.01); *B05D 2203/00* (2013.01); *B05D 2203/30* (2013.01); *B05D 2350/30* (2013.01); *B05D 2350/33* (2013.01); *B05D 2350/35* (2013.01); *B05D 2350/38* (2013.01); *B05D 2601/22* (2013.01)

(58) Field of Classification Search

CPC ..... E01C 11/00; E01C 11/005; E01C 23/028; E01C 23/06; E01C 23/08; E01C 23/081; E01C 23/082; E01C 23/0825; E01C 23/085; E01C 23/0855; E01C 23/088; E01C 23/0885; E01C 23/09; E01C 23/0906; E01C 23/0913; E01C 23/092; E01C 23/0926; E01C 23/0933; E01C 23/094; E01C 23/0946; E01C 23/0953; E01C 23/096; E01C 23/0966; B05D 3/104; B05D 3/12; B05D 5/005; B05D 5/08; B05D 2203/00; B05D 2203/30; B05D 2350/30; B05D 2350/33; B05D 2350/35; B05D 2350/38; B05D 2601/22

USPC ..... 404/17, 19, 20, 70, 72, 75; 427/136, 427/138, 290, 307

See application file for complete search history.

(56) References Cited

U.S. PATENT DOCUMENTS 5,565,032 A * 10/1996 Wyner ..... E01D 22/00 118/315
5,695,389 A * 12/1997 Bartel ..... B24C 3/067 280/47.36
5,998,525 A * 12/1999 Wang ..... C08K 3/0033 428/446
6,155,907 A * 12/2000 Jones ..... C04B 41/5089 404/78

(Continued)

FOREIGN PATENT DOCUMENTS

WO WO 2013/016587 A1 * 1/2013

OTHER PUBLICATIONS

United States Patent and Trademark Office as the International Searching Authority, "International Search Report and Written Opinion," in related PCT application No. PCT/US2012/048416, dated Dec. 7, 2012.

*Primary Examiner* — William P Fletcher, III
(74) *Attorney, Agent, or Firm* — Durham Jones & Pinegar, P.C. Intellectual Property Law group

(57) ABSTRACT

Methods, compositions and systems for prolonging the lives of transportation surfaces, including pavement, runways, bridges and parking structures include physically altering the transportation surface and chemically protecting the transportation surfaces. Physical alteration of a transportation surface may include physically altering one or both of a microtexture and a macrotexture of the transportation surface. Chemical protection of a transportation surface may include hardening and/or densifying the transportation surface. The transportation surface may be chemically protected while physically altering the transportation surface or after the transportation surface has been physically altered.

11 Claims, 3 Drawing Sheets

(56) References Cited

U.S. PATENT DOCUMENTS

| | | | | |
|---|---|---|---|---|
| 8,992,118 | B2 * | 3/2015 | Coe | E01C 23/10<br>404/77 |
| 2006/0063689 | A1 * | 3/2006 | Netherton | C04B 41/009<br>510/240 |
| 2008/0194735 | A1 * | 8/2008 | Verdugo-Perez | C04B 26/18<br>524/4 |

* cited by examiner

METHODS, COMPOSITIONS AND SYSTEMS FOR ENHANCING THE USEFUL LIFE OF A TRANSPORTATION SURFACE

CROSS-REFERENCE TO RELATED APPLICATIONS

A claim for the benefit of priority to U.S. Provisional Patent Application No. 61/511,603, filed on Jul. 26, 2012 (the "'603 Provisional Application"), and to U.S. Provisional Patent Application No. 61/643,219, filed on May 4, 2012 (the "'219 Provisional Application"), is hereby made pursuant to 35 U.S.C. § 119(e). The entire disclosures of the '603 Provisional Application and the '219 Provisional Application are, by this reference, hereby incorporated herein.

TECHNICAL FIELD

This disclosure relates generally to methods, compositions and systems for prolonging the lives of transportation surfaces, including pavement, runways, bridges and parking structures. More specifically, this disclosure relates to the use of techniques for physically altering the top of a transportation surface in conjunction with the use of chemical protectants on the transportation surface to improve the useful lives of the transportation surface.

RELATED ART

Conventionally, when a new transportation surface, such as pavement, a runway, a bridge or a parking structure is laid, the transportation surface has a macrotexture, which is visible to the naked eye. The macrotexture of a transportation surface may be formed in a top of the transportation surface while the transportation surface is formed. A variety of processes may be used to form macrotexture, including tinning, raking, chain dragging, burlap drag, brooming and the like. Macrotexture may impart the top of the transportation surface with skid resistance and provide recesses into which liquids (e.g., water, etc.) may flow. In addition, the macrotexture may provide channels that enable liquids to flow off of and away from the transportation surface. In any event, the macrotexture of a transportation surface may prevent the collection, or pooling, of liquids on surfaces where friction (e.g., with the tires of vehicles traveling across the transportation surface, etc.) is desired and, thus, may reduce hydroplaning and, thus, enable the transportation surface to maintain its frictional characteristics in wet weather conditions.

In addition to macrotexture, new transportation surfaces also include microtexture. Microtexture typically includes the fine roughness features on the aggregate of a transportation surface, as well as smaller particles, such as fine sands. These features are often barely, if at all, visible to the naked eye. The fine roughness features of microtexture provide the majority of the friction (i.e., skid resistance) that is usually desired on transportation surfaces.

Over time, weather, use, and a variety of other factors diminish the quality of transportation surfaces, including their microtexturing and, often, their macrotexturing. This is particularly true on diamond ground surfaces, which often lose macrotexturing with age when they are located in climates where wet and freezing conditions are common. As vehicles travel over transportation surfaces, their tires generate friction that causes those surfaces to wear. In addition to wearing the transportation surface, small pieces of rubber that are worn from the tires and other debris become trapped in fine roughness features of the microtexture, effectively smoothing or polishing and removing the texture of the pavement. Transportation surfaces that are exposed to harsh conditions (e.g., extremes in weather, prolonged periods of snow and/or ice, etc.) wear particularly fast.

The damaging effects of wear, water and freeze/thaw cycles cause transportation surfaces to lose their texture (e.g., macrotexture) over time, which may distress the transportation surface. Initial scaling (i.e., the flaking or peeling of the finished surface) and/or cracking may lead to aggregate pop-outs, which may then lead to spalling. Once the top of the transportation surface begins to erode, other issues arise, such as early rutting, corrosion of rebar within the transportation surface and alkali silica reactivity (ASR).

In recent years, a variety of retexturing techniques have been used in an effort to restore the microtexture and, sometimes, the macrotexture of a worn transportation surface, as well as to eliminate unevenness, rutting and/or surface deterioration. Retexturing often requires the removal of a layer of material from the top of the transportation surface, a process known in the art as "re-profiling" (e.g., by diamond grinding, a combination of diamond grinding and grooving, etc.), which may expose more porous underlying portions of the transportation surface. Consequently, a retextured transportation surface may be more prone to wear or other damage than a new transportation surface, necessitating the need for further retexturing in a shorter period of time. It is generally accepted that a transportation surface may be re-profiled up to three times. However, re-profiling may cause fatigue, which may lead to further damage to the transportation surface.

Weather (e.g., freezing and thawing, etc.) and other conditions (e.g., use of de-icing chemicals, the use of tire chains, etc.) may also cause transportation surfaces to crack and/or scale. Conventionally, cracks and scaling have ultimately lead to more extensive damage to the pavement and have required costly repairs, which often include the removal of material from the top of a transportation surface and the formation of an overlay, or cutting out sections of the transportation surface, along with doweling and replacement.

When retexturing will not restore the desirable characteristics of a transportation surface, more drastic measures must be taken. Conventionally, such measures include removal (e.g., by diamond grinding and, optionally, grooving; etc.) and replacement (e.g., forming an overlayment of a transportation surface material on the remaining portion of the existing transportation surface; doweling and patching; wearing course; etc.) of the damaged surface in a partial-depth repair process known as "overlaying." Alternatively, one or more sections of the transportation surface may be completely removed and replaced.

SUMMARY

The present disclosure relates to methods, compositions and systems for enhancing the life of a transportation surface (e.g., a vehicular pavement, such as a highway or a road; a highway ramp; a bridge deck; a runway; a pedestrian walkway; etc.). The disclosed methods, compositions and systems may be used on transportation surfaces formed from a variety of different materials, including, without limitation, concrete and asphalt.

The life of a transportation surface may, in various embodiments, be enhanced by imparting the transportation surface with wear and abrasion resistance, or increased durability. These characteristics may reduce the rates at which age, climate conditions (e.g., wet weather, freeze/thaw conditions, etc.), maintenance (e.g., snow removal, deicing, etc.), abrasion and use cause the transportation surface to incur rutting, scaling, cracking, or spalling, or to lose skid resistance or otherwise deteriorate.

A method for enhancing the life of a transportation surface may include chemically protecting the transportation surface. Such chemical protection may include hardening and/or densifying a surface of the transportation surface. Hardening and/or densification may include the application of a hardener, such as a lithium-based product (e.g., lithium polysilicate, colloidal silica, etc.), to the transportation surface. Chemical protection may be effected without diminishing the frictional characteristics of the transportation surface. In some embodiments, chemical protection of a transportation surface may be effected alone; i.e., without any other treatment, such as physical alteration of the transportation surface. Optionally, a transportation surface may be treated with a protective compound that prevents scaling of the transportation surface, a compound that protects the transportation surface from corrosive agents, a protective compound that seals the transportation surface (i.e., prevent migration of moisture therein), or a compound that otherwise extends the useful life of the transportation surface.

Different types of protection may be combined in simultaneous or sequential applications to the transportation surface. As an example, an anti-corrosive chemical (e.g., lithium nitrate, etc.) and/or a sealer (e.g., silane, etc.), may be applied and permitted to penetrate into the transportation surface before a hardener, such as a colloidal silica or a lithium polysilicate, is applied to the transportation surface. In some embodiments, the hardener may be applied to the transportation surface before the anti-corrosive chemical and/or sealer cures or otherwise dries.

In other embodiments, chemical protection of a transportation surface may accompany physical alteration of the transportation surface. Physical alteration of a transportation surface may include enhancement (e.g., restoration, improvement, etc.) of a texture of the transportation surface, or an increase in a surface area of a top of the transportation surface. Some embodiments of physical alteration include increasing a so-called "microtexture" of the transportation surface. Microtexture includes the microscopic roughness (e.g., roughness features with a texture relief of less than about 0.5 mm) of the transportation surface. A so-called "macrotexture" of the transportation surface, which includes larger features, such as projections, depressions, grooves, and the like, visible to the naked eye (e.g., features having a texture relief of about 0.5 mm or more) are increased in some embodiments. Physical alteration, including enhancement of the microtexture of the transportation surface, may include the removal of material from the top of the transportation surface, and may include increasing porosity at the top of the transportation surface. Material removal may be accomplished mechanically (e.g., by slot blasting, grinding, grooving, abrasion, etching, pressure washing, etc.), chemically or otherwise.

When physical alteration and chemical protection processes are used in conjunction with one another to enhance a transportation surface, the physical alteration may precede the chemical protection. Alternatively, the physical alteration and chemical protection may be concurrently effected. In such embodiments, the chemical protection may inhibit further damage to the physically altered (e.g., texture-enhanced, restored, etc.) surface. A physically altered transportation surface may be chemically protected by hardening and/or densifying a top of the transportation surface, preventing scaling at the top of the transportation surface, protecting the transportation surface from corrosive agents, sealing the transportation surface, or otherwise treating the transportation surface in a manner that extends its life. The transportation surface may be chemically protected without undesirably diminishing the frictional characteristics obtained by its physically alteration.

The disclosed processes may be used to improve a new transportation surface (e.g., new pavement; a new overlay, or topper (e.g., whitetop, blacktop, etc.); etc.) or to refresh an existing transportation surface. When used to enhance the useful life of a new transportation surface, a disclosed method (e.g., chemical protection and optional physical alteration) may be effected after an initial cure of transportation surface, within thirty (30) days after placement of the transportation surface, or at any other appropriate time. As a specific, but not limiting example, light shot blasting may be used to facilitate the release and removal of a curing agent from the top of a transportation surface while increasing a microtexture of the transportation surface. The light shot blasting may be accompanied by or followed by chemical protection.

Methods of this disclosure may also be used to refresh an existing transportation surface when the microtexture and/or macrotexture of the existing transportation surface is insufficient or when wear on the surface, or surface polishing, renders the transportation surface unsafe or close to unsafe (e.g., the surface has an undesirably low skid number, etc.).

In another aspect, this disclosure relates to protective compounds for chemically protecting a transportation surface. In some embodiments, a protective compound may be configured or formulated to harden and/or densify a transportation surface (e.g., it may include a lithium polysilicate, a sodium silicate, a potassium silicate, etc.). More specifically, such a protective compound may include a lithium-based densifier, such as a lithium polysilicate or a colloidal silica. In addition to the lithium-based densifier, such a protective compound may include an anti-scaling agent (e.g., a metal siliconate, such as a transition metal siliconate, a post-transition metal siliconate, an alkali metal alkyl siliconate (e.g., potassium methyl siliconate, potassium propyl siliconate, sodium methyl siliconate, etc.), a magnesium fluorosiliconate, etc.) and/or a sealer (e.g., silane, etc.), as well as water. In some specific embodiments, the composition may include, consist essentially of, or even consist of a densifier (e.g., colloidal silica, etc.), a metal siliconate, silane and water.

According to another aspect, a system for enhancing the useful life of a transportation surface may include a physical alteration component for physically altering a top of the transportation surface and a protective compound for chemically protecting the transportation surface. Among a variety of possible embodiments, the physical alteration component may comprise a shot blaster, a diamond grinder, a diamond groover, a diamond grinder/groover, a sand blaster, a pressure washer, or the like. Embodiments of compounds for chemically protecting the transportation surface include, but are certainly not limited to, hardeners and/or densifiers, anti-scaling agents and/or sealers.

Other aspects, as well as features and advantages of various aspects, of the disclosed subject matter will become apparent to those of ordinary skill in the art through consideration of the ensuing description, the accompanying drawings, and the appended claims.

DETAILED DESCRIPTION

Figure 1:
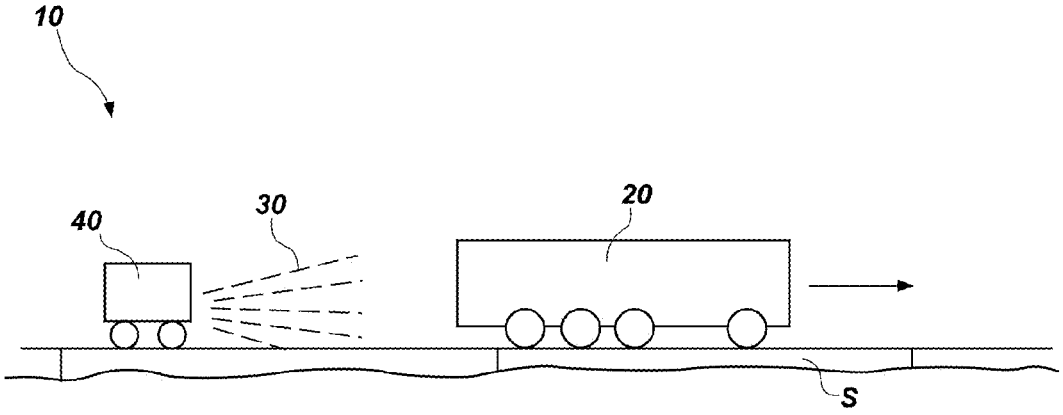
FIG. 1 is schematic representation of an embodiment of a system for extending the useful life of a transportation surface.

FIG. 1 illustrates an embodiment of a system 10 for enhancing a useful life of a transportation surface S, such as pavement, a runway, a bridge, a parking structure, or the like. The system 10 includes a physical alteration component 20, a protective compound 30 and, optionally, an applicator 40 for introducing the protective compound 30 onto the transportation surface S.

The physical alteration component 20 may comprise any apparatus that will alter the texture of a transportation surface S. In some embodiments, the physical alteration component 20 may be configured to increase or at least partially restore microtexturing of the transportation surface S. A physical alteration component 20 may increase microtexturing by generating a physical impact against the transportation surface S. Non-limiting examples of such a physical alteration component 20 include shot blasting equipment (e.g., that available from Blastrac, N.A. of Oklahoma City, Okla., etc.) and diamond grinding equipment (e.g., that available from Diamond Surface, Inc., of Rogers, Minn., etc.). As another option, a physical alteration component 20 may chemically increase microtexturing (e.g., by etching the transportation surface S, etc.). Microtexturing may be restored by a physical alteration component 20 that forces contaminants (e.g., particles of rubber, dirt, oil, etc.) from microtexturing that may already be present in the transportation surface S. A couple of examples of such a physical alteration component 20 include, but are not limited to, sand blasting equipment and pressure washing equipment. In some embodiments, the physical alteration component 20 (e.g., a diamond grinder and/or groover, etc.) may also increase macrotexturing of the transportation surface S or impart the transportation surface S with macrotexturing.

Once a transportation surface S has been physically altered, it may be cleaned (e.g., by pressure spray, etc.). Cleaning may remove bitumen residues or buildup on the aggregate, thereby exposing microtexture and, thus, enhancing the performance of the physical alteration process.

The applicator 40 of a system 10 for enhancing a useful life of a transportation surface S may be configured to apply a protective compound 30 in the form of a liquid or a slurry. In some embodiments, the applicator 40 may be configured to spray the protective compound 30 onto a transportation surface S. Such an applicator 40 may be configured to spray the protective compound 30 under sufficient pressure (e.g., 750 psi to 30,000 psi, or 5 MPa to 200 MPa, or more, etc.) to expose microtexturing in the transportation surface S. Alternatively, the applicator 40 may be configured to generate a relatively low pressure spray of protective compound 30. In other embodiments, the applicator 40 may be configured to drop a stream of protective compound 30 onto a transportation surface S, to roll protective compound 30 onto a transportation surface S, or to apply the protective compound 30 to a transportation surface S in any other acceptable manner.

The protective compound 30 may comprise any type of compound that will protect the transportation surface S and prevent wearing of or damage to the same. In a specific embodiment, the protective compound 30 may comprise a hardener and/or densifier. As other options, a protective compound 30 may prevent scaling of the transportation surface S, protect the transportation surface S from corrosive agents, seal the transportation surface S, or otherwise extend the useful life of the transportation surface S. In some embodiment, the protective compound 30 may be configured to perform a combination of these functions.

Figure 2A:
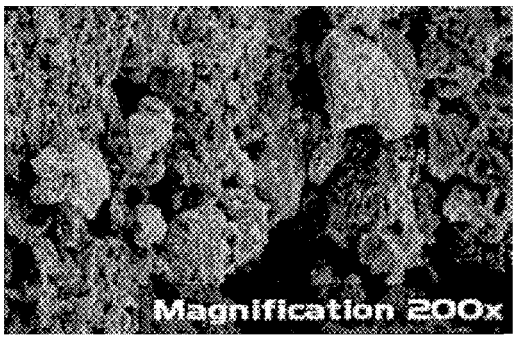
FIGS. 2A and 2B are, respectively, images of a surface prior to treatment with a lithium-based densifier embodiment of a protective compound and after treatment with the lithium-based densifier.
Figure 2B:
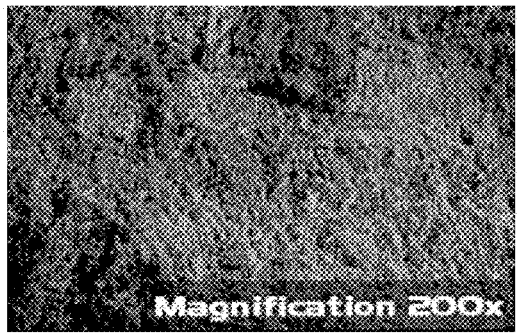

In embodiments where the protective compound 30 hardens and/or densifies the transportation surface S, it may include a lithium-based hardener. Examples of lithium-based hardeners include lithium polysilicates and colloidal silicas. When applied to a concrete surface, lithium-based hardeners penetrate pores and microcracks in the surface. The lithium of lithium-based hardeners stabilizes the silicate, enabling it to remain in solution for a sufficient amount of time (i.e., longer than sodium silicates since lithium ions are larger than sodium ions and can stabilize more silica in the colloidal state than sodium ions) to penetrate the pores and/or microcracks in the concrete and to react with calcium hydroxide. In some embodiments, other types of hardeners may be used as the protective compound 30, including, without limitation, sodium silicates or potassium silicates. As the silicate reacts with calcium hydroxide, calcium silicate hydrate (the same product produced when water is added to Portland cement) is formed. As a comparison of FIG. 2A (untreated concrete surface) to FIG. 2B (hardened concrete surface) demonstrates, calcium silicate hydrate chemically hardens, reduces the porosity of, and densifies the surface of the concrete, which increases the surface strength of the concrete, as well as the ability of the concrete to resist wear from abrasion. The greater the porosity at the surface, the further the lithium-based hardener and/or densifier will penetrate into the concrete. Moreover, hardeners, including, without limitation, lithium-based hardeners, may react with the mineral make up of various aggregates (e.g., aggregates used in cementitious materials, such as concrete; aggregates used in asphalts (particularly lime-based aggregates); etc.) while enhancing the hardness of the aggregates. The residue from lithium-based hardeners is a dust, which is more easily removed from a treated surface than the residues of other alkali metal silicates, which form crusts on concrete surfaces.

A protective compound 30 that has been formulated to prevent scaling may be configured to render the transportation surface S more water-resistant, or to facilitate drying of the transportation surface S. An anti-scaling protective compound 30 may include a component that reacts with a material of the transportation surface S to strengthen the same. By way of non-limiting example, a protective compound 30 may include a metal siliconate (e.g., a transition metal siliconate, a post-transition metal siliconate, an alkali metal alkyl siliconate, etc.).

Anti-corrosive agents that may be useful as at least part of a protective compound 30 include, without limitation, nitrates or nitrites. In a specific embodiment, a protective compound 30 may include lithium nitrate, which may prevent or counteract the effects of alkali silica reactivity (ASR).

A sealer (i.e., an agent that prevents migration of moisture into a transportation surface) may be designed to penetrate and absorb into the pores and microfissures of the minerals from which aggregates (e.g., of cementitious materials, such as concrete; of asphalt; etc.) are formed, which may react in a manner that provides an insoluble structure that fortifies and strengthens the aggregate. Silane is an example of a sealer that may be included in a protective compound 30.

Protective compounds 30, such as hardeners and/or sealers, that chemically and/or structurally reinforce the aggregate of a transportation surface S may increase the durability and safety of the transportation surface S.

The following EXAMPLES provide formulations for various embodiments of protective compound 30:

EXAMPLE 1

| Component | Amount (percentage, by weight) |
|---|---|
| Lithium polysilicate | about 20% |
| Alkali Metal Siliconate (sodium methyl siliconate, potassium methyl siliconate or potassium propyl siliconate) | about 6% to about 15% |
| Silane | about 2% |
| Water | balance |

EXAMPLE 2

| Component | Amount (percentage, by weight) |
|---|---|
| Colloidal silica | about 15% |
| Alkali Methyl Siliconate | about 15% |
| Silane | about 2% |
| Water | balance |

Various studies have been performed to determine the effectiveness of the disclosed techniques in enhancing or extending the useful lives of transportation surfaces. The EXAMPLES that follow provide further insight in various embodiments and aspects of the disclosed subject matter.

EXAMPLE 3

The California Department of Transportation (Caltrans) sponsored experimental research in which concrete pavement wear on a test section of U.S. Interstate Highway 80 ("I-80") over Donner Pass was evaluated over a twelve (12) month period of time. It is well known that the Donner Pass section of I-80 experiences some of the harshest conditions in the United States in terms of snow-removal, tire chains and tire studs, and deicing salts. As expected, during the test and observation period, the test section was subjected to frequent snow plowing, traffic with snow chains and traffic with studded tires.

The test section included a three lane wide, one mile long section of I-80 at Donner Pass. It was divided into three subsections. Prior to treatment and testing, rut depths were measured at locations in each of the three subsections. A first of the three subsections served as a control; it was not subjected to physical alteration or chemically protected. A second of the three subsections was not physically altered, but was treated with a lithium polysilicate densifier. The third subsection was shot blasted, then treated with the lithium polysilicate densifier. Twelve (12) months after treatment, rut depths were again obtained from different locations across the three subsections. The results are set forth in the following table:

TABLE 1

| Core ID | Treatment | Wear (in.) | Wear (in.) | Wear (mm) |
|---|---|---|---|---|
| C1 | No shot blasting; no densifier (Control) | 0.1875 | 3/16 | 0.7382 |
| C3 | Control | 0.2500 | 1/4 | 0.9843 |
| C4 | Control | 0.2500 | 1/4 | 0.9843 |
| C6 | Control | 0.2500 | 1/4 | 0.9843 |
| C10 | Control | 0.1250 | 1/8 | 0.4921 |
| C12 | Control | 0.1875 | 3/16 | 0.7382 |
| | Average Wear of Control Section | 0.2083 | 3/16+ | 0.8202 |
| D1 | Densifier over shotblasting (DOS) | 0.0625 | 1/16 | 0.2461 |
| D3 | DOS | 0.1250 | 1/8 | 0.4921 |
| D5 | DOS | 0.0625 | 1/16 | 0.2461 |
| D6 | DOS | 0.0625 | 1/16 | 0.2461 |
| D7 | DOS | 0.0000 | 0 | 0.0000 |
| D8 | DOS | 0.0625 | 1/16 | 0.2461 |
| | Average Wear of DOS Section | 0.0625 | 1/16 | 0.2461 |

As TABLE 1 illustrates, the physically altered and chemically protected subsection exhibited only about one third the wear of the untreated control subsection. These results indicate that the lithium polysilicate densifier has delayed loss of and damage to the material of the transportation surface, suggesting that the polysilicate densifier has reduced the porosity of the transportation surface and improved its hardness. Further, because the rate of wear has been significantly reduced by the lithium polysilicate densifier, these results suggest that physical alteration of the transportation surface has improved pavement friction and aggregate skid resistance.

EXAMPLE 4

In other experimentation, a thirty-three (33) month field test sponsored by the Oklahoma Department of Transportation was conducted along a section of U.S. Highway 77 ("US-77") near Oklahoma City, Okla. to confirm that a protective compound, a lithium-based densifier, does not present a safety threat when applied to transportation surfaces. The section of US-77 that was tested included concrete pavement, and was divided into two subsections: a first of which had been subjected only to shot blasting and a second of which had been subjected to shot blasting and chemical protection with a lithium-based densifier.

Figure 3:
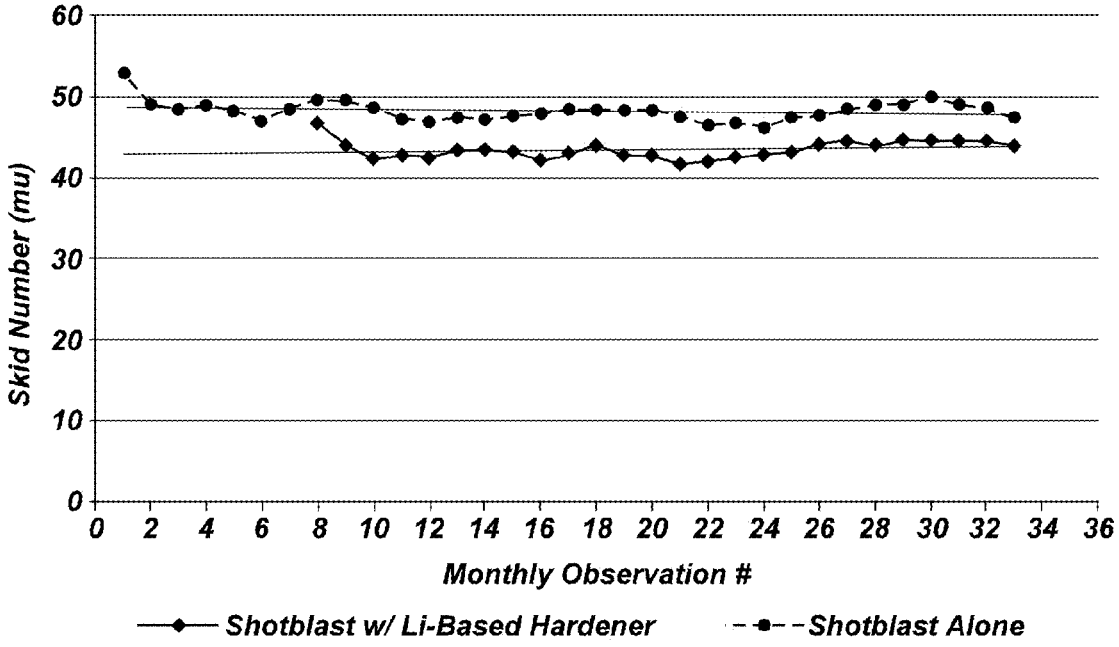
FIG. 3 is a graph depicting the effect of an embodiment of a method for extending the useful life of a transportation surface on the safety of the transportation surface; and FIGs, 4 and 5 are graphs depicting the protection that a protective compound may provide for a transportation surface.

During the course of the study, skid numbers were obtained from each subsection on a monthly basis (thirty-three (33) months for the shot blast-only treated surface; twenty-six (26) months for the shot blast and a lithium-based densifier-treated surface). The results, which are depicted by FIG. 3, demonstrate that the application of a lithium-based densifier to a physically altered transportation surface only marginally decreases the skid number of the transportation surface. Nonetheless, the skid number (approximately 44) of that subsection remained well above safe limits and, thus, the lithium-based densifier did not compromise the safety of the transportation surface. These results indicate that the application of a protective compound to a physically altered transportation surface will not substantially diminish the skid number, or frictional characteristics, of the transportation surface.

EXAMPLE 5

In another study, the abilities of embodiments of the materials set forth in EXAMPLES 1 and 2 to prevent scaling of concrete surfaces were evaluated. In that study, forty-eight (48) plastic tubs, each having an inside dimension of 7.5 inches by 12.5 inches, were filled with a concrete mixture (at a w/cm ratio of 0.45 and including 564.00 lb/yd$^3$ cement type I/II, 1207.00 lb/yd$^3$ sand, 1807.00 lb/yd$^3$ aggregate #1, 254.00 lb/yd$^3$ water and a design air content of 6.5%) to a depth of 3 inches. The concrete within each tub was then finished with a broom. The concrete within each tub was flooded with water, then the tub and the concrete therein were covered and stored at room temperature (23° C.±2° C.) for fourteen (14) days, during which the concrete moist-cured.

After the fourteen (14) day moist cure, the concrete samples were removed from their tubs and air dried at room temperature (23° C.±2° C.) and fifty percent (50%) relative humidity for seven (7) days (i.e., until the samples were twenty-one (21) days old. The inside surfaces of the plastic tubs were abraded.

At the end of that seven (7) day period, each concrete sample was secured within a plastic tub with NOVALINK concrete caulk, which was applied around the top side and edge of each concrete sample. The caulk was permitted to cure for three (3) days. At this point, the concrete samples were twenty-four (24) days old.

At that point in time, a protective compound according to EXAMPLE 1 was applied to top surfaces of a first test group of sixteen (16) of the concrete samples, while a protective compound according to EXAMPLE 2 was applied to the top surfaces of a second test group of sixteen (16) of the concrete samples. The protective compounds of EXAMPLES 1 and 2 were applied at a volume equivalent to one gallon/150 ft$^3$ of concrete. The concrete samples were then allowed to sit for four (4) days. An equivalent amount of water was applied to the remaining sixteen (16) concrete samples, which served as a control group.

Two of the concrete samples of each group were reserved as controls, to which 400 ml of water was applied to each of these samples. Volumes of 400 ml of seven (7) different deicing chemicals were applied to two more concrete samples from each group. The deicing chemicals that were used included: (1) the calcium chloride deicer available as DOWFLAKE from Dow Chemical Company; (2) the magnesium chloride hexahydrate deicer available as DUSTGARD from North American Salt Company; (3) the potassium acetate deicer available as E-36 from Cyrotech; (4) the lithium potassium acetate deicer available as LITHMELT® from the Lithium Division of FMC; (5) the beet juice extract deicer available as Gen-3-64/Di-H2O (D3) from Basic Solutions; (6) kosher salt (NaCl) available from Diamond Crystal Salt; and (7) the calcium magnesium acetate deicer available as CMA Deicer from Cryotech.

Figure 4:
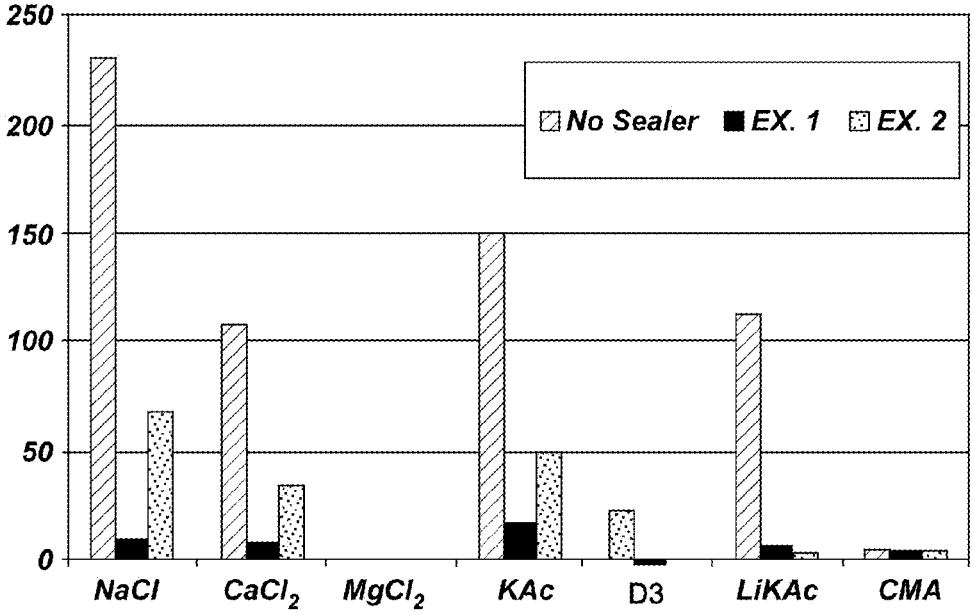
Figure 5:
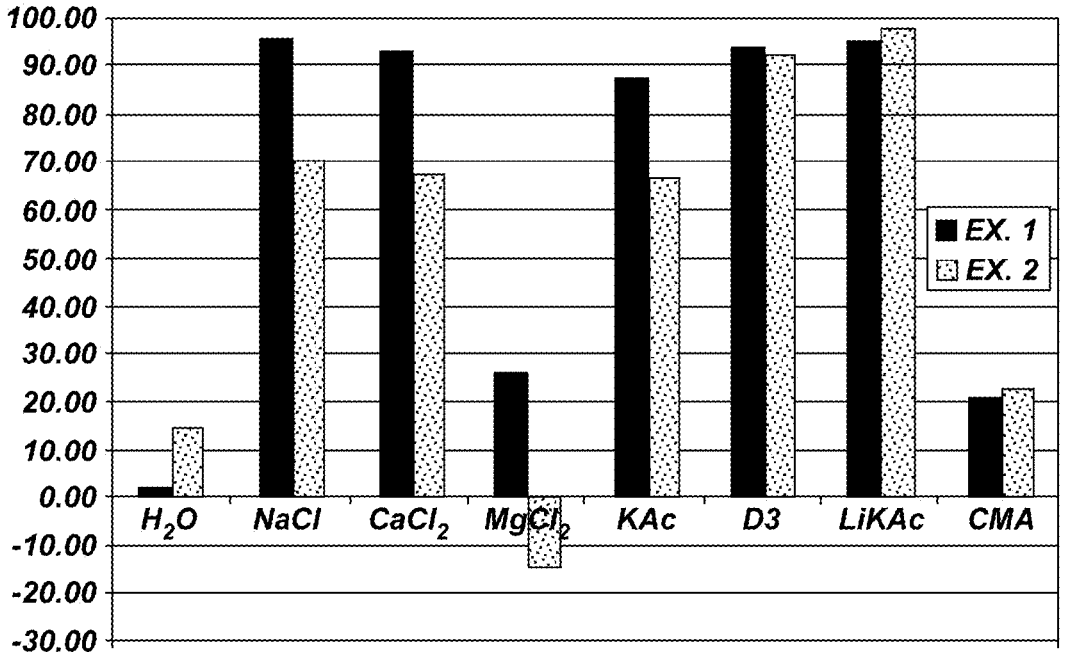

With the water and deicers on the concrete samples, they cycled between a temperature of −18° C. for about sixteen (16) hours and a temperature of 23° C.±8° C. for eight hours. After the completion of five of these freeze/thaw cycles, the concrete samples were flushed with tap water, and the eroded aggregate and paste were collected in funnels; one funnel corresponding to each concrete sample. Each time aggregate and paste were collected, they were dried overnight at a temperature of about 38° C. and their weight was determined and recorded. This process was completed five (5) times for each concrete sample, subjecting each concrete sample to a total of twenty-five (25) freeze/thaw cycles and five (5) measurements. The collective amounts of paste and aggregate from each sample were weighed to provide an indication of the effectiveness of the protective compounds of EXAMPLE 1 and EXAMPLE 2 against no chemical protection and against one another when exposed to various deicers. FIGS. 4 and 5 illustrate the cumulative weight loss from the various concrete samples, and demonstrates that the compounds of EXAMPLE 1and EXAMPLE 2 actually prevented erosion of the concrete samples, with the composition of EXAMPLE 1 performing slightly better than the composition of EXAMPLE 2.

In the past, it has taken about seven (7) years for new pavement along the Donner Pass section of I-80 to fail (i.e., to develop ruts having a depth of 10 millimeters). When failure occurs, the uppermost surface of the pavement is typically removed and the pavement is white-topped with a thin (e.g., four inch thick, etc.) layer of concrete. However, the predicted service life for a thin layer of white-topped concrete is 6.3 years to 7.1 years. In comparison, as demonstrated by the data provided in EXAMPLE 3, physically altering the same pavement (with shot blasting) and chemically protecting it (with a lithium-based hardener) doubles or even triples the life of the pavement. For new pavement, this means a prolonged life of about 14 years up to about 21 years. Alternatively, treatment of whitetop in accordance with teachings of this disclosure would also add a significant amount of time to the useful life of the whitetop. In any event, teachings of this disclosure reduce long-term costs associated with the repair and/or replacement of transportation surfaces, as well as costs associated with disruptions in the flow of traffic.

Although the foregoing description contains many specifics, these should not be construed as limiting the scopes of the inventions recited by any of the appended claims, but merely as providing information pertinent to some specific embodiments that may fall within the scopes of the appended claims. Features from different embodiments may be employed in combination. In addition, other embodiments may also lie within the scopes of the appended claims. All additions to, deletions from and modifications of the disclosed subject matter that fall within the scopes of the claims are to be embraced by the claims.

What is claimed:

1. A method for treating a transportation surface, consisting of:

physically altering a microtexture and/or macrotexture of the transportation surface by blasting the transportation surface, grinding the transportation surface, and/or grooving the transportation surface, to impart the transportation surface with an enhanced microtexture and/or macrotexture; and applying a protective chemical for hardening and densifying the transportation surface to the transportation surface during or after physically altering the microtexture and/or macrotexture of the transportation surface, the protective chemical hardening and densifying the transportation surface relative to a transportation surface to which no protective chemical for hardening and densifying a transportation surface has been applied and to maintain the enhanced microtexture and/or macrotexture of the transportation surface.

2. The method of claim 1, wherein physically altering comprises physically altering the microtexture of the transportation surface.

3. The method of claim 1, wherein applying the protective chemical comprises applying a colloidal silica, a lithium polysilicate, a potassium silicate, or a sodium silicate to the transportation surface.

4. The method of claim 1, wherein physically altering the transportation surface comprises removing a layer of material of the transportation surface from at least portions of the transportation surface.

5. The method of claim 1, wherein physically altering and applying the protective chemical decrease a rate of wear of the transportation surface by at least about half of a rate of wear experienced by an untreated transportation surface exposed to identical conditions.

6. The method of claim 1, wherein physically altering and applying the protective chemical decrease a rate of wear of the transportation surface to about one third of a rate of wear experienced by an untreated transportation surface exposed to identical conditions.

7. The method of claim 1, wherein physically altering and applying the protective chemical are effected on a new transportation surface, on an overlay for a transportation surface, or on an old transportation surface.

8. A system for increasing durability of a transportation surface, consisting of:

a physical alteration component for physically altering a microtexture of the transportation surface, the physical alteration component capable of blasting the transportation surface, grinding the transportation, and/or grooving the transportation surface, to impart the transportation surface with an enhanced microtexture; and a protective chemical for hardening and densifying the transportation surface relative to a transportation surface to which the protective chemical has not been applied, the protective chemical formulated to maintain the enhanced microtexture of the transportation surface.

9. The system of claim 8, wherein the physical alteration component comprises a shot blaster, a diamond grinder, a diamond groover, a pressure washer, a sand blaster, or an etchant.

10. The system of claim 8, wherein the protective chemical comprises a hardener/densifier and at least one of an anti-scaling agent, an anticorrosive agent, and a sealer.

11. The system of claim 8, wherein the protective chemical consists essentially of:

a lithium-based hardener;

a metal siliconate; and silane.

* * * * *